US010189678B2

(12) United States Patent
Rudd

(10) Patent No.: US 10,189,678 B2
(45) Date of Patent: Jan. 29, 2019

(54) ELEVATOR STRIP BONDED END TERMINATION

(71) Applicants: ThyssenKrupp AG, Essen (DE); ThyssenKrupp Elevator AG, Essen (DE)

(72) Inventor: Jonathan D. Rudd, Memphis, TN (US)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/484,809

(22) Filed: Apr. 11, 2017

(65) Prior Publication Data

US 2018/0290861 A1 Oct. 11, 2018

(51) Int. Cl.
*B66B 7/00* (2006.01)
*B66B 7/08* (2006.01)
*B66B 9/00* (2006.01)

(52) U.S. Cl.
CPC . *B66B 7/08* (2013.01); *B66B 9/00* (2013.01)

(58) Field of Classification Search
CPC ..... B66B 7/08; B66B 7/085
See application file for complete search history.

(56) References Cited

U.S. PATENT DOCUMENTS 4,043,690 A * 8/1977 Browne ..... B66B 7/08 29/460
4,200,768 A 4/1980 Anhalt et al.
4,673,309 A * 6/1987 Schlaich ..... E01D 19/14 164/108
5,211,500 A 5/1993 Takaki et al.
5,415,490 A * 5/1995 Flory ..... F16G 11/05 24/122.6
6,061,879 A * 5/2000 Ericson ..... B66B 7/085 24/122.6
6,256,841 B1 * 7/2001 Ericson ..... B66B 7/085 24/136 R
6,778,743 B1 * 8/2004 Kordahi ..... G02B 6/3889 385/107
7,578,035 B2 * 8/2009 Dold ..... B66B 7/062 24/136 R
8,752,361 B2 6/2014 Smeets et al.
9,422,134 B2 8/2016 Ikonen et al.
9,840,397 B2 * 12/2017 Zapf ..... B66B 7/062
(Continued)

FOREIGN PATENT DOCUMENTS

EP 2687751 A2 1/2014
EP 3163119 A1 5/2017
(Continued)

*Primary Examiner* — Michael A Riegelman
(74) *Attorney, Agent, or Firm* — The Webb Law Firm

(57) ABSTRACT

An elevator end termination includes a base member including a proximal end and a distal end and defining an internal belt cavity opening at the proximal end of the base member, an elevator belt comprising an outer jacket and an internal load carrier of a substantially rectangular cross-section, wherein the internal load carrier is exposed on an end of the elevator belt, in which a portion of the elevator belt end is positioned in the belt cavity, and an adhesive provided in the belt cavity at least between opposite sides of the elevator belt and opposing interior walls of the base member, in which the elevator belt is adhesively bonded to the base member.

10 Claims, 4 Drawing Sheets

(56) References Cited

U.S. PATENT DOCUMENTS

| | | | | |
|---|---|---|---|---|
| 2002/0000346 | A1* | 1/2002 | Baranda | B66B 7/06 187/254 |
| 2004/0206579 | A1* | 10/2004 | Baranda | B66B 7/06 187/254 |
| 2006/0175137 | A1* | 8/2006 | Alves | B66B 7/062 187/254 |
| 2007/0017749 | A1* | 1/2007 | Dold | B66B 7/085 187/251 |
| 2010/0307674 | A1 | 12/2010 | MacKay | |
| 2011/0259677 | A1 | 10/2011 | Dudde et al. | |
| 2014/0182975 | A1* | 7/2014 | Ikonen | B66L 35/0031 187/251 |
| 2014/0230194 | A1* | 8/2014 | Moeschen-Siekmann | F16G 3/00 24/115 H |
| 2015/0101889 | A1* | 4/2015 | Kere | B66B 7/085 187/254 |
| 2015/0151948 | A1* | 6/2015 | Pelto-Huikko | B66B 9/00 187/254 |
| 2015/0307323 | A1* | 10/2015 | Zapf | B66B 7/062 187/411 |
| 2016/0152445 | A1* | 6/2016 | Lehtinen | B66B 7/085 187/393 |
| 2016/0207739 | A1* | 7/2016 | Pelto-Huikko | B66L 39/00 |
| 2016/0272466 | A1* | 9/2016 | Helenius | B66B 5/0031 |
| 2016/0355378 | A1* | 12/2016 | Lehtinen | B66B 7/085 |
| 2017/0036891 | A1* | 2/2017 | Lehtinen | B66B 7/085 |
| 2017/0121149 | A1* | 5/2017 | Lehtinen | B66L 319/02 |
| 2017/0217730 | A1* | 8/2017 | Helenius | B66B 7/085 |

FOREIGN PATENT DOCUMENTS

| | | | |
|---|---|---|---|
| GB | 993510 | A | 5/1965 |
| WO | 2009109060 | A1 | 9/2009 |

* cited by examiner

ELEVATOR STRIP BONDED END TERMINATION

BACKGROUND OF THE INVENTION

Field of the Invention

This disclosure relates generally to an end termination for use with an elevator system and, more particularly, to a strip bonded end termination for use with an elevator system.

Description of Related Art

A conventional traction elevator system includes a car, at least one counterweight, two or more ropes or steel corded flat belts interconnecting the car and counterweights, a motor arrangement for moving the car and counterweight, and end terminations for each end of the ropes at connection points with the building, car, counterweight, and/or a frame of the motor arrangement. The ropes are traditionally formed of laid or twisted steel wire that are easily and reliably terminated by mechanical compression end terminations. The steel corded flat belts traditionally include steel cords with small cross-sections as load carrying components and a non-metallic sheath encasing the steel cords. Steel corded flat belts can also be reliably terminated by mechanical compression end terminations. Currently, however, the industry is moving towards using flat belts that have fiber reinforced polymer materials for the load carrying component. A fiber reinforced polymer load carrying component is more sensitive to pinching and crushing than a steel load carrying component. Therefore, there is a current need for an end termination for use with a fiber reinforced polymer belt in an elevator system that optimizes terminations and load transfer of the fiber reinforced polymer belt.

End terminations are important components in elevator systems since the end terminations transfer the load between the belt ends and structural elements or moving components, such as elevator cars and/or counterweights. A malfunction of an end termination can cause serious damage on an elevator and poses a serious safety risk to passengers. In the event the belt slips or breaks in the end termination, the belt, which is connected to the termination, is loose and cannot transfer the load between the car and the counterweight. In order to prevent such an event, the load transfer between the belt and the belt end termination should be evenly distributed across the transfer area to prevent local damage to the belt. A wedge-type end termination may be used, in which the belt is arranged around a single wedge. The wedge and the belt together are held in a wedge socket. By using this wedge-type end termination arrangement, however, it is often difficult to achieve an evenly distributed load transfer that does not cause local damage in each operating situation. It is difficult to accurately achieve a desired load transfer that does not cause local damage since the contact zone with the single wedge-type end termination arrangement is often variable and unpredictable after the belt is seated under load. Further, the single wedge of the wedge-type termination arrangement often degrades the performance of fiber reinforced polymer load carriers due to the clamping force and the small radii of the wedge.

SUMMARY OF THE INVENTION

In view of the foregoing, a need exists for an end termination that provides a smooth load transfer between the car and the counterweight for a fiber reinforced polymer load carrier. There is a further need for an end termination that does not degrade performance or damage a belt held in the end termination.

In accordance with one aspect, an elevator end termination includes a base member including a proximal end and a distal end and defining an internal belt cavity opening at the proximal end of the base member, an elevator belt comprising an outer jacket and an internal load carrier of a substantially rectangular cross-section, in which the internal load carrier is exposed on an end of the elevator belt, in which a portion of the elevator belt end is positioned in the belt cavity, and an adhesive provided in the belt cavity at least between opposite sides of the elevator belt and opposing interior walls of the base member, in which the elevator belt is adhesively bonded to the base member.

In accordance with another aspect, the internal load carrier is exposed on the portion of the elevator belt end that is adhesively bonded to the base member. The base member further includes a plate operatively connected to the base member to form the belt cavity. The base member and the plate are connected to one another using a fastener extending through the base member and the plate. The adhesive includes one or more of an epoxy, urethane, cyanoacrylates, or other single or multi-part structural adhesive. The base member is an integrally formed monolithic structure. The base member includes at least one injection port to inject adhesive into the belt cavity between elevator belt end and the interior walls of the belt cavity. The at least one injection port includes a plurality of injection ports positioned to inject the adhesive between the opposite sides of the elevator belt end and the interior walls of the belt cavity. The base member includes at least one exit port provided on the proximal end of the base member to permit the adhesive to exit from the belt cavity at the proximal end of the base member. At least one tab is positioned between the exposed internal load carrier and the base member.

In accordance with another aspect, an elevator system includes at least one elevator car hoisted and lowered by an elevator belt, the elevator belt comprising an outer jacket and an internal load carrier of a substantially rectangular cross-section, the internal load carrier being exposed on an end of the elevator belt, at least one end termination operatively connected to the elevator belt and the elevator car, the end termination including a base member including a proximal end and a distal end and defining an internal belt cavity opening at the proximal end of the base member, in which a portion of the elevator belt end is positioned in the belt cavity, and an adhesive provided in the belt cavity at least between opposite sides of the elevator belt and opposing interior walls of the base member, in which the elevator belt is adhesively bonded to the base member.

In accordance with another aspect, the internal load carrier is exposed on the portion of the elevator belt end that is adhesively bonded to the base member. The base member further includes a plate operatively connected to the base member to form the belt cavity. The base member and the plate are connected to one another using a fastener extending through the base member and the plate. The adhesive includes one or more of an epoxy, urethane, cyanoacrylates, or other single or multi-part structural adhesive. The base member is an integrally formed monolithic structure. The base member includes at least one injection port to inject adhesive into the belt cavity between elevator belt end and the interior walls of the belt cavity. The at least one injection port includes a plurality of injection ports positioned to inject the adhesive between the opposite sides of the elevator belt end and the interior walls of the belt cavity. The base member includes at least one exit port provided on the proximal end of the base member to permit the adhesive to exit from belt cavity at the proximal end of the base member. At least one tab is positioned between the exposed internal load carrier and the base member.

Further aspects will now be described in the following numbered clauses.

Clause 1: An elevator end termination, comprising a base member comprising a proximal end and a distal end and defining an internal belt cavity opening at the proximal end of the base member; an elevator belt comprising an outer jacket and an internal load carrier of substantially rectangular cross-section, wherein the internal load carrier is exposed on an end of the elevator belt, wherein a portion of the elevator belt end is positioned in the belt cavity; and an adhesive provided in the belt cavity at least between opposite sides of the elevator belt and opposing interior walls of the base member, wherein the elevator belt is adhesively bonded to the base member.

Clause 2: The elevator end termination of Clause 1, wherein the internal load carrier is exposed on the portion of the elevator belt end that is adhesively bonded to the base member.

Clause 3: The elevator end termination of Clause 1 or Clause 2, wherein the base member further comprises a plate operatively connected to the base member to form the belt cavity.

Clause 4: The elevator end termination of Clause 3, wherein the base member and the plate are connected to one another using a fastener extending through the base member and the plate.

Clause 5: The elevator end termination of any of Clauses 1-4, wherein the adhesive comprises one or more of an epoxy, urethane, cyanoacrylates, or other single or multi-part structural adhesive.

Clause 6: The elevator end termination of any of Clauses 1-5, wherein the base member is an integrally formed monolithic structure.

Clause 7: The elevator end termination of any of Clauses 1-6, wherein the base member comprises at least one injection port to inject adhesive into the belt cavity between elevator belt end and the interior walls of the belt cavity.

Clause 8: The elevator end termination of Clause 7, wherein the at least one injection port comprises a plurality of injection ports positioned to inject the adhesive between the opposite sides of the elevator belt end the interior walls of the belt cavity.

Clause 9: The elevator end termination of Clause 7 or Clause 8, wherein the base member comprises at least one exit port provided on the proximal end of the base member to permit the adhesive to exit from the belt cavity at the proximal end of the base member.

Clause 10: The elevator end termination of Clause 9, further comprising at least one tab positioned between the exposed internal load carrier and the base member.

Clause 11: An elevator system, comprising at least one elevator car hoisted and lowered by an elevator belt, the elevator belt comprising an outer jacket and an internal load carrier of a substantially rectangular cross-section, wherein the internal load carrier is exposed at an end of the elevator belt; at least one end termination operatively connected to the elevator belt and the elevator car, the end termination comprising: a base member comprising a proximal end and a distal end and defining an internal belt cavity opening at the proximal end of the base member, wherein a portion of the elevator belt end is positioned in the belt cavity; and an adhesive provided in the belt cavity at least between opposite sides of the elevator belt and opposing interior walls of the base member, wherein the elevator belt is adhesively bonded to the base member.

Clause 12: The elevator system of Clause 11, wherein the internal load carrier is exposed on the portion of the elevator belt adhesively bonded to the base member.

Clause 13: The elevator system of Clause 11 or Clause 12, wherein the base member further comprises a plate operatively connected to the base member to form the belt cavity.

Clause 14: The elevator system of Clause 13, wherein the base member and the plate are connected to one another using a fastener extending through the base member and the plate.

Clause 15: The elevator system of any of Clauses 11-14, wherein the adhesive comprises one or more of an epoxy, urethane, cyanoacrylates, or other single or multi-part structural adhesive.

Clause 16: The elevator system of any of Clauses 11-15, wherein the base member is an integrally formed monolithic structure.

Clause 17: The elevator system of any of Clauses 11-16, wherein the base member comprises at least one injection port to inject adhesive into the belt cavity between the elevator belt end and the interior walls of the belt cavity.

Clause 18: The elevator system of Clause 17, wherein the at least one injection port comprises a plurality of injection ports positioned to inject the adhesive between the opposite sides of the elevator belt end and the interior walls of the belt cavity.

Clause 19: The elevator system of Clause 17 or Clause 18, wherein the base member comprises at least one exit port provided on the proximal end of the base member to permit the adhesive to exit from the belt cavity at the proximal end of the base member.

Clause 20: The elevator system of Clause 19, further comprising at least one tab positioned between the exposed internal load carrier and the base member.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, an end termination for an elevator system and, in particular, to a strip bonded end termination for an elevator system. Certain preferred and non-limiting aspects of the components of the end termination are illustrated in FIGS. 1-11.

Figure 1:
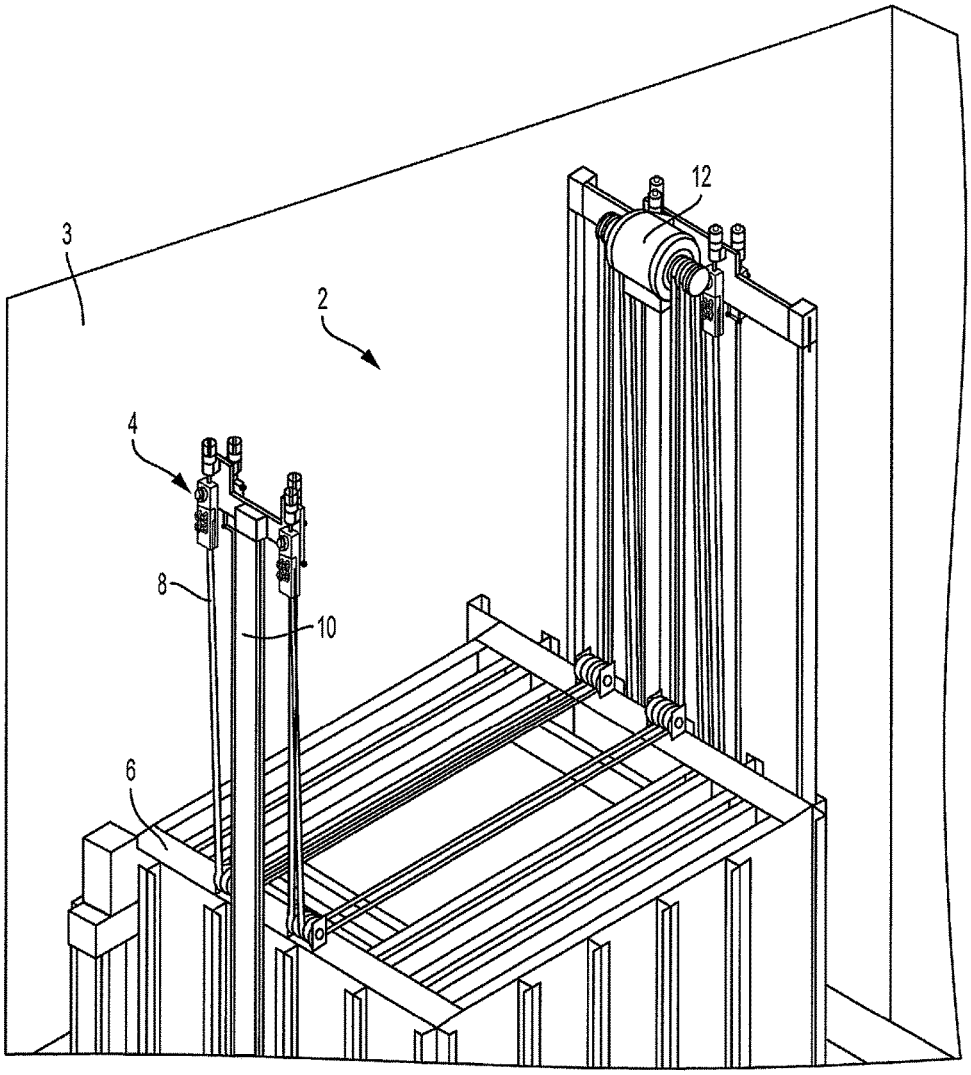
FIG. 1 is a perspective view of an elevator system according to an example of the present disclosure.

With reference to FIG. 1, an elevator system 2 utilizing at least one end termination 4 is shown. The elevator system 2 may include an elevator car 6 and counterweight movable within an elevator shaft 3 using a plurality of belts 8 that hoist and/or lower the elevator car 6. In one example, the elevator system 2 includes four belts 8 configured to move the elevator car 6 and counterweight within the elevator shaft. Each end of each belt 8 may be held in a separate end termination 4 held on another component of the elevator system 2. The other component of the elevator system 2 may be one or more of the elevator car 6, a support beam or structure 10 of the elevator car 6 and/or counterweight, a portion of the elevator shaft, or the counterweight. In the illustrated example, the elevator system 2 utilizes eight separate end terminations 4 to control the load transfer between the elevator car 6 and a counterweight. A motor arrangement 12 may be configured to drive the belts 8 to lift and lower the elevator car 6.

Figure 2:
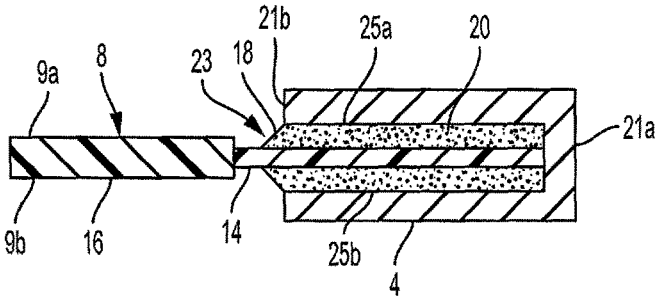
FIG. 2 is a schematic cross-sectional view of an end termination according to an embodiment of the present disclosure.
Figure 10:
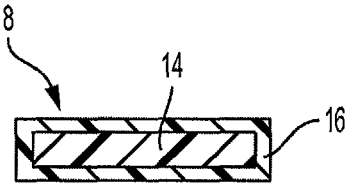
FIG. 10 is a cross-sectional view of a belt according to one embodiment of the present disclosure.
Figure 11:
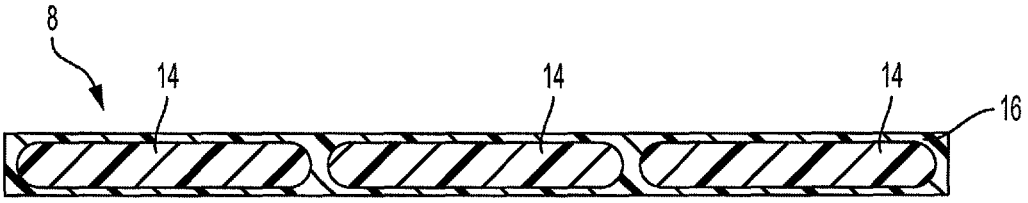
FIG. 11 is a cross-sectional view of a belt according to another embodiment of the present disclosure.

With reference to FIG. 2, one embodiment of the end termination 4 is shown and described. In the illustrated example, the end termination 4 is a strip bonded belt termination. FIG. 2 shows a schematic cross-sectional illustration of the general concept of the present disclosure. FIGS. 4A, 5, 6A, 7A, 8, and 9 show alternative versions of the end termination 4 that may utilize this concept for securing the belt 8 within the end termination 4. To avoid excessive cinching that can occur using a single wedge end termination, at least a portion of the belt 8 is secured within the end termination 4 using an adhesive bond in a bonded joint connection. The bonded joint connection is established between the load carrier 14 of the belt 8 and the end termination 4. In one example, the belt 8 includes a first side 9*a* and a second, opposing side 9*b*. The belt 8 also includes an outer jacket 16 and the load carrier 14 held within the jacket 16. The jacket 16 is made of a polymer and the load carrier 14 is made of a fiber reinforced polymer, such as glass or carbon. In one example, the load carrier 14 is made of carbon fiber held in an epoxy matrix. One example of the belt 8 is shown and disclosed in U.S. Patent Application Publication No. 2011/0259677 to Dudde et al., the disclosure of which is incorporated by reference in its entirety. As shown in FIG. 10, in one embodiment of the belt 8, the belt 8 includes a single load carrier 14 and an outer jacket 16. As shown in FIG. 11, in another embodiment of the belt 8, the belt 8 includes a plurality of load carriers 14 and an outer jacket 16. The plurality of load carriers 14 may be stacked on top of one another in the outer jacket 16 or may be spaced adjacently apart from one another in the outer jacket 16.

As shown in FIG. 2, a portion of the jacket 16 is stripped from an end of the belt 8 to expose the inner load carrier 14. In one example, the portion of the jacket 16 is completely removed from the end of the belt 8 to expose the inner load carrier 14 in a continuous manner. In another example, the jacket 16 is substantially removed from the end of the belt 8 to expose the inner load carrier 14 but some portions of the jacket 16 are left on the end of the belt 8. In another example, only portions of the jacket 16 are removed from the end of the belt 8 such that the inner load carrier 14 is exposed in a segmented or staggered manner. The exposed load carrier 14 is inserted into the end termination 4 and an adhesive 18 is injected into an inner cavity 20 of the end termination 4. In one example, the adhesive 18 is injected into the end termination 4 to completely fill the inner cavity 20 with adhesive 18. The adhesive 18 is injected above and below the exposed load carrier 14 to establish an adhesive bond between the load carrier 14 and the end termination 4. In another example, the adhesive 18 is applied to the exposed load carrier 14 before insertion into the end termination 4. Adhesive may also be injected into the end termination 4 before the belt 8 is inserted therein. The adhesive bond established between the load carrier 14 and the end termination 4 is primarily a chemical adhesion bond that uses molecular bonds established between the load carrier 14 and the end termination 4 and the adhesive 18 to secure the belt 8 within the end termination 4.

In one example, the adhesive 18 is made of an epoxy resin and hardener. In other embodiments, the adhesive 18 is urethane, cyanoacrylates, or any other single or multi-part structural adhesive. During injection of the adhesive 18 onto the exposed load carrier 14 and/or into the end termination 4, the adhesive 18 is a substantially viscous liquid. In another example, the adhesive 18 is a block of epoxy and hardener that is positioned on each side of the exposed load carrier 14 or within the inner cavity 20 of the end termination 4. After application of the adhesive 18 on the exposed load carrier 14 and/or the end termination 4, the adhesive 18 is cured to establish the chemical bond between the adhesive 18 and the exposed load carrier 14 and/or the end termination 4. In one embodiment, the load carrier 14 is bonded to the end termination 4 before the end termination 4 and the belt 8 are installed in the elevator system 2 to allow the adhesive to cure without any loads affecting the bond. The adhesive 18 may be cured using heat or ultraviolet light, among other methods of curing an adhesive. By using the chemical bonding between the adhesive 18 and the exposed load carrier 14 and/or the end termination 4 eliminates the need for mechanical locking of the belt 8 within the end termination 4, which reduces the amount of clamping force needed to retain the belt 8 within the end termination 4.

The amount of adhesive 18 needed to establish a sufficient bond between the end termination 4 and the belt 8 depends on the load to be held by the belt 8, the type of belt 8 used in the elevator system 2, the size of the belt 8 used in the elevator system 2, and the length and thickness of the inner cavity 20 of the end termination 4. Therefore, different types and/or amounts of adhesive 18 can be used to establish the bond between the end termination 4 and the belt 8 depending on the conditions of the elevator system 2. Likewise, the bond area for the adhesive 18 is adjustable depending on the conditions of the elevator system 2. In one example, the bond area of the adhesive 18 on each side of the exposed load carrier 14 is, in one embodiment, in the range of approximately 4,363 $mm^2$-96,000 $mm^2$ for a 120 kN (26,977 lb) rated belt 8. In another embodiment, the range is approximately 2,363 $mm^2$-52,000 $mm^2$ for a 65 kN (14,612 lb) rated belt 8. In another embodiment, the range is approximately 1,454 $mm^2$-32,000 $mm^2$ for a 40 kN (8,992 lb) rated belt 8. In another embodiment, the range is approximately 1,090 $mm^2$-24,000 $mm^2$ for a 30 kN (6,744 lb) rated belt 8. The bond area and thickness are used to control the desired pull out strength of the end termination 4. The pull out strength is amount of force necessary to pull the belt 8 out of the end termination 4, which corresponds to the amount of load or weight that each end termination 4 is capable of withstanding. In one example, the inner surfaces of the inner cavity 20 of the end termination 4 are roughened or finished to increase the bonding strength between the adhesive 18 and the end termination 4. In one example, a coating is applied to the inner surfaces of the end termination 4 to increase the bonding strength between the adhesive 18 and the end termination 4. Likewise, a coating can be applied to the exposed load carrier 14 to increase the bond strength between the adhesive 18 and the exposed load carrier 14.

Figure 3:
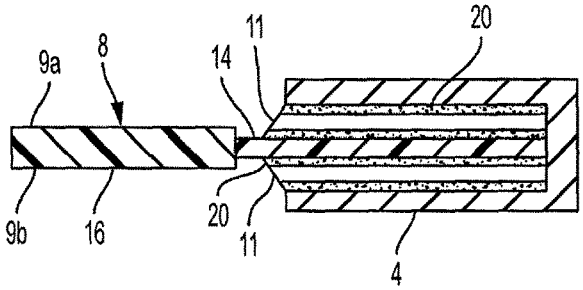
FIG. 3 is a schematic cross-sectional view of an end termination with four adhesion sections according to another embodiment of the present disclosure.

With reference to FIG. 3, another embodiment of the end termination 4 is shown and described. FIGS. 4B, 5, 6B, 7B, 8, and 9 show alternative versions of the end termination 4 that may utilize this concept for securing the belt 8 within the end termination 4.

As shown in FIG. 3, another embodiment of the end termination 4 includes substantially the same features of the embodiment of the end termination 4 shown in FIG. 2. The end termination 4 shown in FIG. 3, however, includes at least one tab 11 positioned between the exposed load carrier 14 and the end termination 4. In one embodiment, one tab 11 is provided between the exposed load carrier 14 and the end termination 4. This tab 11 may be provided above or below the exposed load carrier 14 within the adhesive 18. In another embodiment, at least two tabs 11 are provided between the exposed load carrier 14 and the end termination 4. One tab 11 may be provided within the adhesive 18 above the exposed load carrier 14 and one tab 11 may be provided within the adhesive 18 below the exposed load carrier 14. The tab 11 may be made of metal or plastic. It is also contemplated, however, that other materials may be used for the tab 11. The tabs 11 allow for vibration dampening for the adhesive 18. There may be an increase in the surface contact between the exposed load carrier 14 and the tab 11 for the adhesive 18. The tabs 11 permit more compressive force and protect the exposed load carrier 14 from contacting the end termination 4. In one embodiment, different adhesives 18 may be applied to each side of the tabs 11, such that the adhesive that bonds the exposed load carrier 14 to the tab 11 is different from the adhesive that bonds the tab 11 to the end termination 4.

Figure 4A:
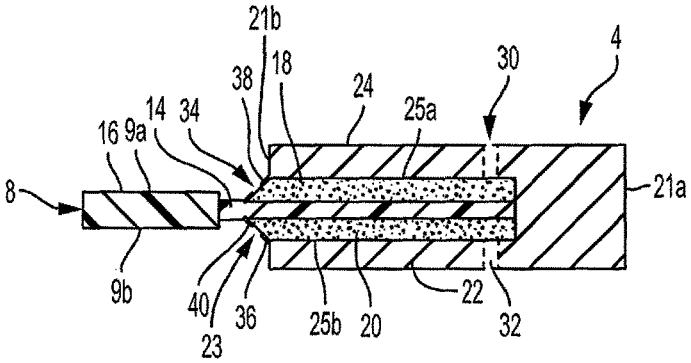
FIG. 4A is a cross-sectional view of an alternative embodiment of the end termination according to FIG. 2.

As shown in FIG. 4A, another example of the end termination 4 includes a porting arrangement for supplying the adhesive 18 to the exposed load carrier 14 portion of the belt 8. In one example of the end termination 4, at least one injection port 30, 32 is defined in the end termination 4 to supply adhesive 18 to the inner cavity 20 of the end termination 4. One injection port 30 is defined in a top portion of the end termination 4. Another injection port 32 is defined in a bottom portion of the end termination 4. The injection ports 30, 32 extend from an outer surface of the end termination 4 to the inner cavity 20 of the end termination 4. The injection ports 30, 32 are sufficiently sized to receive a nozzle or spout of an adhesive delivery device (not shown) that can extend through the injection ports 30, 32 into the inner cavity 20 to avoid injecting adhesive 18 into the injection ports 30, 32 themselves, which can cause clogging or stoppage in the injection ports 30, 32. The top injection port 30 is configured to supply adhesive 18 to the top surface of the exposed load carrier 14. The bottom injection port 32 is configured to supply adhesive 18 to the bottom surface of the exposed load carrier 14. In one example, the injection ports 30, 32 are positioned near the innermost portion of the inner cavity 20 to ensure the adhesive 18 is delivered to the innermost portion of the exposed load carrier 14. It is also contemplated that the injection ports 30, 32 may be provided at different positions in the end termination 4. It is further contemplated that additional injection ports may be defined in the end termination 4 to assist in injecting additional adhesive 18.

With further reference to FIG. 4A, the end termination 4 includes at least one exit port 34, 36 on an open end of the end termination 4. In one example, one exit port 34 is provided on an upper portion of the end termination 4 and one exit port 36 is provided on a lower portion of the end termination 4. The exit ports 34, 36 are sufficiently sized to allow excess adhesive 18 to exit out of the end termination 4 as the adhesive 18 is injected into the end termination 4 through the injection ports 30, 32. In one example, the exit ports 34, 36 are defined in port plates 38, 40 that extend from the end of the end termination 4. The port plates 38, 40 may be formed integral with the base member 22 and the plate 24. In another example, the port plates 38, 40 are removably connected to the base member 22 and the plate 24, such that a user can attach the port plates 38, 40 to the end termination 4 to inject the adhesive 18 into the end termination 4 and can remove the port plates 38, 40 after the adhesive 18 has been cured in the end termination 4.

Figure 4B:
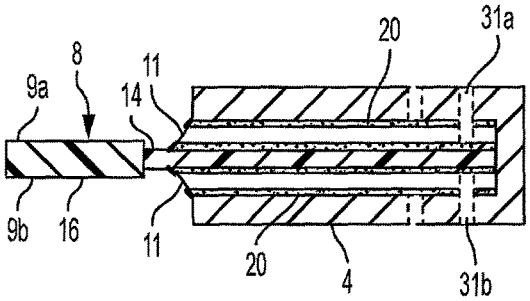
FIG. 4B is a cross-sectional view of an alternative embodiment of the end termination of FIG. 3.

As shown in FIG. 4B, the porting arrangement of the end termination 4 of FIG. 4A can also be used with the end termination of FIG. 3 that includes the tabs 11. In this arrangement, additional channels 31*a*, 31*b* may defined in the end termination 4 and the tabs 11 to permit delivery of the adhesive 18 between the exposed load carrier 14 and the tab 11. The channels 31*a*, 31*b* extend through the end termination 4 and the tabs 11. One channel 31*a* may be defined in the upper portion of the end termination 4 and one channel 31*b* may be defined in the lower portion of the end termination 4.

Figure 5:
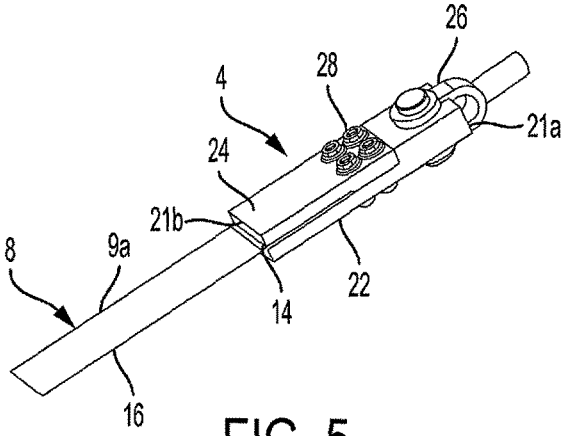
FIG. 5 is a perspective view of an alternative embodiment of the end termination according to any one of FIG. 2-FIG. 4.
Figure 6A:
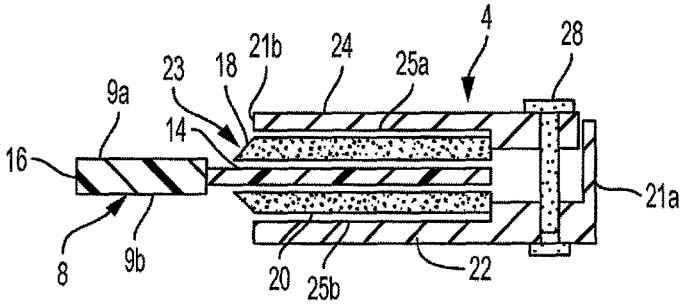
FIG. 6A is a cross-sectional view of an end termination before being bonded with a belt according to any one of FIGS. 2, 4A, and 5.
Figure 6B:
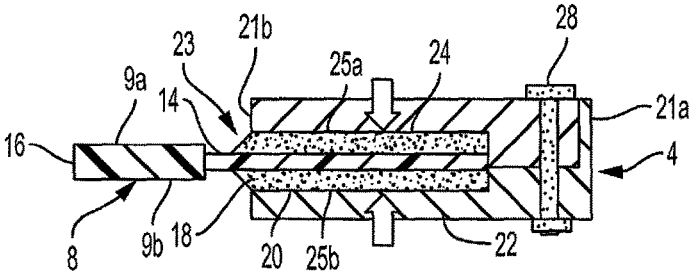
FIG. 6B is a cross-sectional view of the end termination of FIG. 6A after being bonded with the belt.

In another example shown in FIGS. 5-6B, the end termination 4 includes a base member 22 and a plate 24 connected to the base member 22. The end termination 4 has a substantially rectangular shape and a distal end 21*a* and a proximal end 21*b*, but other alternative shapes are also contemplated for the end termination 4. The base member 22 and the plate 24 are connected to form an inner cavity 20 between two interior walls 25*a*, 25*b* with an opening 23 at the proximal end 21*b* of the end termination 4. A connection member 26 is attached to one end of the base member 22 and is configured to connect the end termination 4 to, for example, a portion of the elevator car 6 of the elevator system 2. As shown in FIGS. 5, 6A, and 6B, the base member 22 and the plate 24 are connected to one another using at least one fastener 28 that extends through the base member 22 and the plate 24. In one specific example, four fasteners 28 are used to connect the base member 22 to the plate 24. In one example, the fasteners 28 are bolts. It is contemplated, however, that any alternative fasteners suitable for connecting the base member 22 to the plate 24 may be used. During assembly, the adhesive 18 is applied to the sides of the exposed load carrier 14 and/or the inner surfaces of the base member 22 and the plate 24. The exposed load carrier 14 is positioned between the base member 22 and the plate 24. The base member 22 and the plate 24 are pressed together to hold the exposed load carrier 14 therebetween. The fasteners 28 are then inserted into the base member 22 and the plate 24 and tightened to clamp the exposed load carrier 14 within the end termination 4. The adhesive 18 is then cured to establish a chemical bond between the exposed load carrier 14 and the end termination 4. The fasteners 28 assist in compressing the adhesive 18 between the end termination 4 and the exposed load carrier 14 during the curing phase. It is also contemplated that the belt 8 may be inserted between the base member 22 and the plate 24 first, with the adhesive 18 being injected into the end termination 4 afterwards.

Figure 7A:
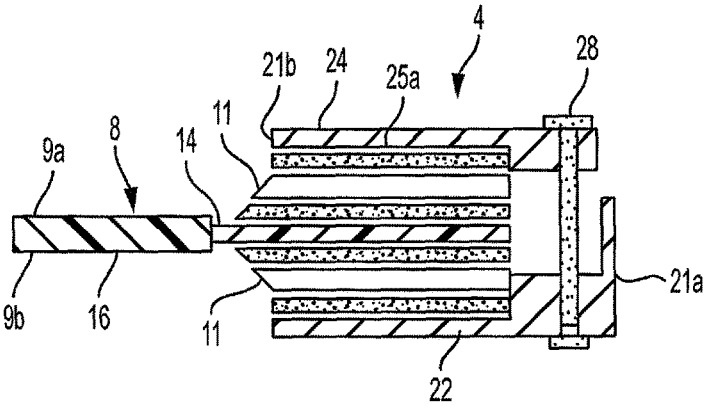
FIG. 7A is a cross-sectional view of an end termination before being bonded with a belt according to any one of FIGS. 3, 4B, and 5.
Figure 7B:
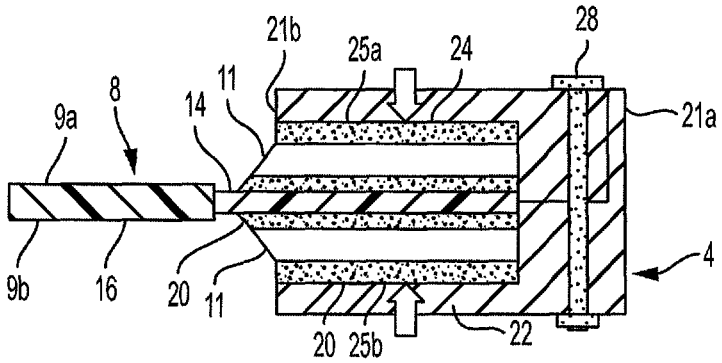
FIG. 7B is a cross-sectional view of the end termination of FIG. 7A after being bonded with the belt.

In another example shown in FIGS. 7A and 7B, the end termination 4 of FIGS. 5-6B may include tabs 11 positioned within the adhesive 18 between the exposed load carrier 14 and the end termination 4. The tabs 11 may be provided according to any example described above in connection with the end termination of FIG. 3.

Figure 8:
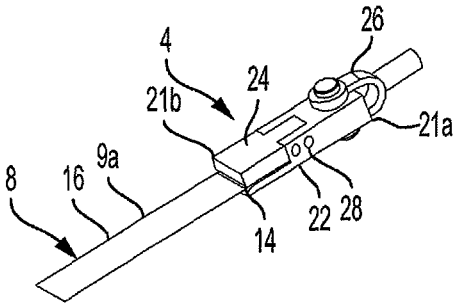
FIG. 8 is a perspective view of an alternative embodiment of the end termination according to any of FIG. 2-4A.

As shown in FIG. 8, another example of the end termination 4 connects the base member 22 and the plate 24 with fasteners that extend through side surfaces of the base member 22 and the plate 24. This example of the end termination 4 includes the same features as the end termination 4 shown in FIG. 3, but, instead, the fasteners 28 extend through the side surfaces of the base member 22 and the plate 24. By using this arrangement of fasteners 28, the possibility of over compressing the exposed load carrier 14 by over tightening the fasteners 28 is reduced.

Figure 9:
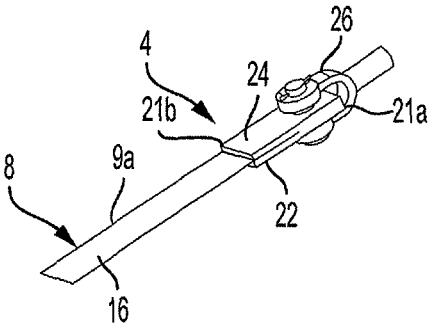
FIG. 9 is a perspective view of an alternative embodiment of the end termination according to any of FIG. 2-4A.

As shown in FIG. 9, another example of the end termination 4 does not utilize fasteners 28 to compress the end termination 4 to the exposed load carrier 14. Instead, the base member 22 and the plate 24 are formed as a single, monolithic structure to hold the belt 8. This example of the end termination 4 also includes a connection member 26 for connecting the end termination 4 to another component of the elevator system 2. In this example, the adhesive 18 can be applied to the exposed load carrier 14 and/or the inner cavity of the end termination 4, and/or the tabs 11 before inserting the exposed load carrier 14 portion of the belt 8 into the end termination 4. After insertion of the exposed load carrier 14 portion of the belt 8 into the end termination 4, a compressive force is applied to the base member 22 and the plate 24 to compress the end termination 4 on the exposed load carrier 14. Methods of applying the compressive force to the base member 22 and the plate 24 include a hydraulic press, a screw driven press, a clamp, and bolts, among other compressing apparatuses.

While several aspects of the elevator end termination are shown in the accompanying figures and described in detail hereinabove, other aspects will be apparent to, and readily made by, those skilled in the art without departing from the scope and spirit of the disclosure. For example, the sides of the end termination 4 can be enclosed or open. The end termination 4 may be shaped so that at least a portion of the exposed load carrier 14 within the end termination 4 is visible for inspection purposes. In other embodiments, the end termination 4 completely covers the entire exposed load carrier 14 within the end termination 4. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. An elevator end termination, comprising:

a base member comprising a proximal end and a distal end and defining an internal belt cavity and an opening at the proximal end of the base member opening to the belt cavity, the belt cavity comprising opposing interior walls;

an elevator belt comprising an outer jacket and an internal load carrier, wherein a portion of the internal load carrier is exposed on an end of the elevator belt, wherein the exposed portion of the internal load carrier is positioned in the belt cavity;

a plate operatively connected to the base member to form the internal belt cavity, the base member and the plate pressed together to hold the exposed portion of the internal load carrier therebetween; and an adhesive provided in the belt cavity at least between opposite sides of the internal load carrier and the opposing interior walls of the belt cavity, wherein the elevator belt is adhesively bonded to the base member.

2. The elevator end termination of claim 1, wherein, the internal load carrier is exposed on the portion of the elevator belt end that is adhesively bonded to the base member.

3. The elevator end termination of claim 1, wherein the base member and the plate are connected to one another using a fastener extending through the base member and the plate.

4. The elevator end termination of claim 1, wherein the adhesive comprises one or more of an epoxy, urethane, cyanoacrylates, or other single or multi-part structural adhesive.

5. The elevator end termination of claim 1, wherein the internal load carrier of the elevator belt is of a substantially rectangular cross section, and wherein the internal belt cavity is rectangular.

6. An elevator system, comprising:

at least one elevator car hoisted and lowered by an elevator belt, the elevator belt comprising an outer jacket and an internal load carrier, wherein a portion of the internal load carrier is exposed on an end of the elevator belt;

at least one end termination operatively connected to the elevator belt and the elevator car, the end termination comprising:

a base member comprising a proximal end and a distal end and defining an internal belt cavity and an opening at the proximal end of the base member opening to the belt cavity, the belt cavity comprising opposing interior walls, wherein the exposed portion of the internal load carrier is positioned in the belt cavity;

a plate operatively connected to the base member to form the internal belt cavity, the base member and the plate pressed together to hold the exposed portion of the internal load carrier therebetween; and an adhesive provided in the belt cavity at least between opposite sides of the internal load carrier and the opposing interior walls of the belt cavity, wherein the elevator belt is adhesively bonded to the base member.

7. The elevator system of claim 6, wherein, the internal load carrier is exposed on the portion of the elevator belt adhesively bonded to the base member.

8. The elevator system of claim 6, wherein the base member and the plate are connected to one another using a fastener extending through the base member and the plate.

9. The elevator system of claim 6, wherein the adhesive comprises one or more of an epoxy, urethane, cyanoacrylates, or other single or multi-part structural adhesives.

10. The elevator system of claim 6, wherein the internal load carrier of the elevator belt is of a substantially rectangular cross section, and wherein the internal belt cavity is rectangular.

* * * * *